US007047956B2

(12) United States Patent
Masaoka et al.

(10) Patent No.: US 7,047,956 B2
(45) Date of Patent: May 23, 2006

(54) KICKBACK PREVENTING DEVICE FOR ENGINE

(75) Inventors: Akira Masaoka, Mori-machi (JP); Atsushi Shimoishi, Mori-machi (JP)

(73) Assignee: Kabushiki Kaisha Moric, Mori-machi (JP)

( * ) Notice: Subject to any disclaimer, the term of this patent is extended or adjusted under 35 U.S.C. 154(b) by 0 days.

(21) Appl. No.: 10/905,911

(22) Filed: Jan. 26, 2005

(65) Prior Publication Data

US 2005/0172939 A1 Aug. 11, 2005

(30) Foreign Application Priority Data

Feb. 9, 2004 (JP) ..... 2004-031832

(51) Int. Cl.
*F02P 5/00* (2006.01)
*F02M 51/00* (2006.01)

(52) U.S. Cl. ..... 123/631; 123/603

(58) Field of Classification Search ..... 123/631, 123/603, 406.53, 406.58, 599
See application file for complete search history.

(56) References Cited

U.S. PATENT DOCUMENTS

| | | | | |
|---|---|---|---|---|
| 4,491,121 | A * | 1/1985 | Miura et al. | 123/631 |
| 4,858,587 | A * | 8/1989 | Hashizume | 123/631 |
| 4,953,520 | A * | 9/1990 | Hashizume | 123/631 |
| 5,778,862 | A * | 7/1998 | Fukui | 123/631 |
| 6,357,398 | B1 * | 3/2002 | Arakawa et al. | 123/41 E |
| 6,694,949 | B1 * | 2/2004 | Ohira et al. | 123/406.58 |
| 6,786,212 | B1 * | 9/2004 | Choi | 123/631 |
| 2004/0107950 | A1 * | 6/2004 | Masaoka et al. | 123/631 |
| 2005/0139194 | A1 * | 6/2005 | Ikeda | 123/406.55 |

* cited by examiner

*Primary Examiner*—Hai Huynh
(74) *Attorney, Agent, or Firm*—Ernest A Beutler

(57) ABSTRACT

A number of embodiments of ignition systems wherein reverse rotation also known as kickback is detected particularly upon engine starting and stopped until the condition has been cleared and forward running is assured.

4 Claims, 8 Drawing Sheets

KICKBACK PREVENTING DEVICE FOR ENGINE

BACKGROUND OF THE INVENTION

This invention relates to an ignition system for an internal combustion engine and more particularly to an ignition system that insures against kick back or reverse rotation from occurring during initial engine start up.

There is disclosed in our co-pending application Ser. No. 10/605,843, filed Oct. 30, 2003, based upon Japanese Application Serial Number 2002-342256 and assigned to the assignee hereof an ignition system that is designed to prevent reverse rotation commonly called "kick back" upon engine starting by detecting a condition where engine speed starts do decrease after the starting operation has begun by disabling the continued ignition until another starting operation has begun.

However that system has a disadvantage as may be best understood by reference to FIGS. 1–3. FIG. 1 illustrates the relevant portion of the engine and its ignition system. As seen in this figure, a shaft of the engine such as its crankshaft 11 or any other shaft that rotates in timed relation to the crankshaft has formed on its peripheral surface a timing mark 12 that has a predetermined circumferential length between its leading edge A and its trailing edge B. This circumferential length may be in any desired range, normally in the range of 30 to 60 degrees.

Cooperating with this timing mark 12 is a sensor 13 of any known construction that is utilized to provide a signal that is transmitted to an ignition system, not shown in these figures. but which will be described in more detail later by reference to the remaining figures that illustrate preferred embodiments of the invention.

The sensor 13 comprises normally a core 13*a* around which a coil 13*b* is wound to produce a pulse signal as shown in FIGS. 2 and 3 as the shaft 11 rotates and the leading and trailing edges A and B pass. The arrow R indicates the normal rotational direction of the shaft 11. The first generated pulse is positive while the second is negative regardless of the direction of rotation.

There may be two modes of reverse rotation in which the engine rotates in reverse after the leading edge A of the projection 12 faces and passes by the core 13*a*. One of these occurs before the trailing end B leaves the sensor core 13*a* (in-projection-reverse rotation). The other (out-of-projection reverse rotation) occurs after the trailing end B leaves the sensor core 13*a* but before top dead center is reached.

FIG. 2 shows the pulse waveform in the in-projection reverse rotation mode. In the normal rotation state during cranking for starting the engine, a rise-up pulse (positive pulse) is produced when the fore-end A of the timing mark is detected by the pulser coil 13 for each rotation of the crankshaft, followed by a decay pulse (negative pulse) when the trailing end B of the projection is detected. When reverse rotation is about to occur, the rotation of the crankshaft slows down gradually. When the rotation speed becomes zero after the pulser coil 13 detects the fore-end A of the timing mark 12 somewhere in the position before reaching the trailing end B and thereafter reverse rotation occurs.

Thus when the leading end A of the timing mark 12 again passes by the detection core 13*a* of the pulser coil 13 after starting reverse rotation, a decay pulse (negative pulse) is produced from the same end A of the timing mark 12. However, the output of the generator decreases due to a decrease in the crankshaft rotation. In accordance with the metholodgy of the aforenoted co-pending application, the reverse rotation of the crankshaft 11 is detected from the decrease in the generator output.

In response to this, an ignition prohibiting signal is given out. As a result, even if the negative pulse is given out the leading end A of the timing mark 12 the ignition signals are prohibited. Thus, if the engine misfires, no combustion occurs in the reverse rotating direction, and kickback is prevented from occurring.

As described, the kickback is prevented from occurring by prohibiting ignition during reverse rotation and the crankshaft 11 will stop rotating. After that, in order to permit re-starting the engine by cranking, the ignition prohibiting state must be cleared. This is done in the aforenoted co-pending application by clearing the ignition prohibiting state upon the input of a first positive pulse. After that, when the trailing end B of the timing mark 12 is detected and a negative pulse is produced, ignition signals are permitted and combustion occurs for the normal rotation of the engine.

FIG. 3 shows the pulse waveform in the out-of-projection reverse rotation. In the normal rotation state during cranking for starting the engine, like the situation of FIG. 2, the fore-end A of the projection is detected for every rotation of the crankshaft and a rise-up pulse (positive pulse) is produced, then a decay pulse (negative pulse) is produced when the trailing end B of the timing mark 12 is detected.

If the rotation speed of the crankshaft gradually slows down and the reverse rotation is about to occur, the leading end A of the timing mark 12 is detected and the timing mark 12 slowly passes by the detecting core 13*a* of the pulser coil 13. Subsequently the trailing end B passes by the detecting position 13*a* and produces a pulse indicated at 14. Here, the rotation speed of the crankshaft 11, when it is low, may becomes zero before the trailing end B reaches the top dead center and the crankshaft 11 will turns in reverse.

As a result, the trailing end B of the timing mark 12 that has once passes by the detecting core 13*a* of the pulser coil 13, returns to the detecting core 13*a*, and is detected to produce a positive pulse 15.

Subsequently, when the leading end A of the timing mark 12 passes by the detecting core 13*a*, a negative pulse 16 is produced. Also this out-of-projection reverse rotation, like the situation shown in FIG. 2, is detected from the decrease in the output of the generator, and ignition is prohibited to prevent kickback from occurring after the reverse rotation occurs.

However and as described above, because the ignition prohibiting state is reset by cranking again after the stop of the crankshaft rotation, ignition prohibition is cleared by the first positive pulse 15 produced after the reverse rotation. Therefore, when the projection end A is detected and a negative pulse 16 is produced after that, ignition signals are given out. Thus rather than preventing reverse rotation, the engine may continue to operate in reverse.

In view of these potential problems it is a principal object of this invention to provide a kickback preventing apparatus and method that is effective to rapidly detect a reverse rotation operation during starting and prevent further reverse rotation by positively preventing ignition and in particular to reliably prevent kickbacks from occurring in the out-of-projection reverse rotation.

SUMMARY OF THE INVENTION

This invention is adapted to be embodied in a kickback preventing ignition system for an internal combustion engine having a rotating shaft and a timing mark rotating with the shaft and having circumferentially spaced leading and trailing ends. A sensor is associated with the timing mark and is adapted to produce pulses when said each of the leading and trailing ends pass under rotation of a shaft. A processor determining that reverse rotation may be occurring based on a sensed decrease in value of at least one of the pulses and prohibits ignition of the engine and reestablishes ignition upon the production of a pulse from the leading edge of the timing mark unless a predetermined time period has elapsed.

DETAILED DESCRIPTION

Figure 4:
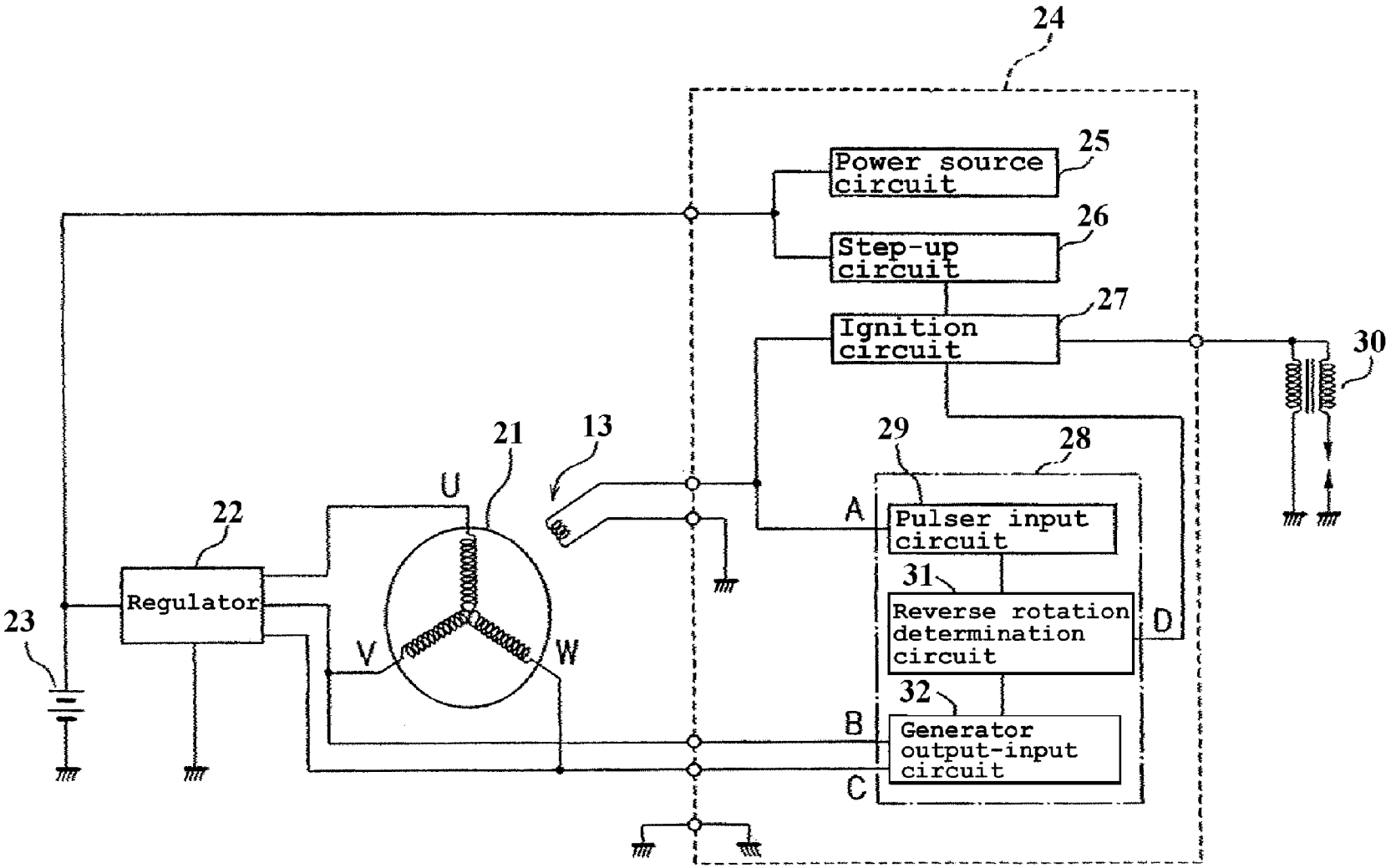
FIG. 4 is a partially schematic view of a first circuit and construction for precluding kickback (reverse rotation).

FIG. 4 shows a circuit constitution for determining reverse rotation in accordance with a first embodiment of the invention in a partially schematic form. This circuit includes a three-phase generator 21 provided at an end of a crankshaft (not shown) of an associated engine in a manner well known in the art. The generator 21 has three-phase coils as a portion of a stator facing a magnet arrangement positioned on the inside surface of a rotor that generally comprises a flywheel, attached to the end of the crankshaft of the engine. Three-phase output terminals U, V, and W are connected through a regulator 22 for rectification and prevention of over-voltage to a battery 23.

Figure 1:
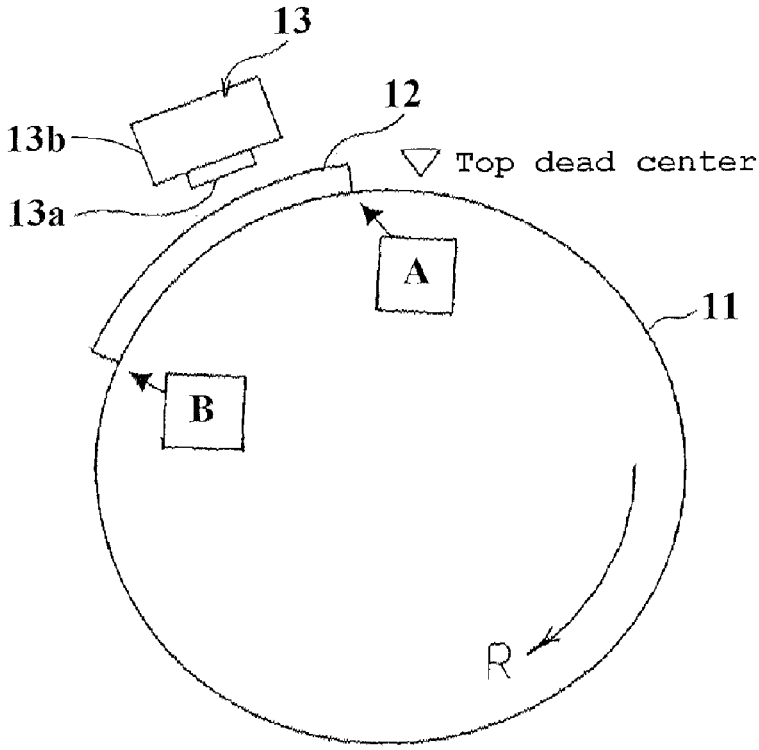
FIG. 1 is a partially schematic view of a timing and kickback sensor to illustrate the problems with the prior art and to describe the types of kick back that may occur on engine starting.

A rotor (not shown) having a timing mark as aforenoted by reference to FIG. 1 for detecting rotary angle is attached to the crankshaft. A pulser coil or sensor 13 for detecting the timing mark is provided opposite the outer side of the rotor, as was described in FIG. 1. The pulser coil 13 detects both ends A and B of the timing mark, extending for example by an arcuate angle of about 60 degrees on the side face of the rotor. These are sensed as changes in magnetic flux and produce positive and negative pulser signals, one each per rotation. The positive and negative pulser signals are the rise-up pulse (positive pulse) and decay pulse (negative pulse), respectively, as aforenoted.

The pulser coil 13 outputs these pulses to an ignition system 24 for controlling ignition of the engine. This ignition system 24 consists of a power source circuit 25 connected to the battery 23, a step-up circuit 26 for obtaining a specified ignition voltage, an ignition circuit 27 connected to the pulser coil 13, and a kickback preventing circuit 28. The ignition circuit 27 applies the ignition voltage to an ignition coil 30 at an appropriate crank angle position in accordance with any desired control routine in response to the pulser signal coming from the pulser coil 13 and other desired engine running conditions as sensed in desired manners.

The kickback preventing circuit 28 is comprised of a pulser input circuit 29, a reverse rotation determination circuit 31, and a generator output-input circuit 32. The pulser input circuit 29 is connected to the pulser coil 13 through a terminal A to receive pulser signals. The generator output-input circuit 32 is connected through terminals B and C to any two-phase terminals (V and W terminals in this example) of the generator 21 and receives output voltage of the generator 21.

Figure 2:
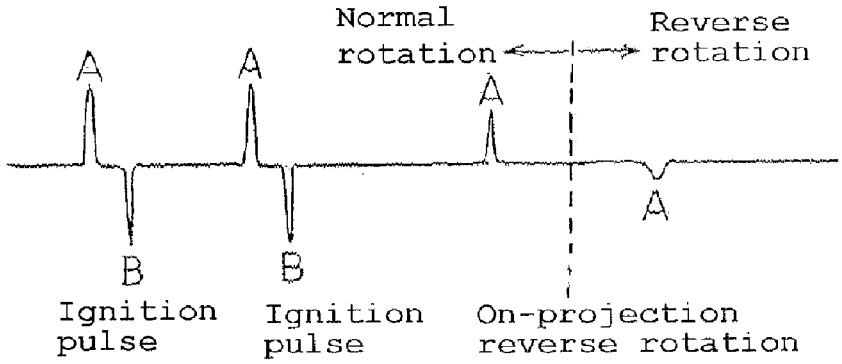
FIG. 2 is a wave form of the sensor outputs during a situation where reverse rotation occurs during the time when the timing mark is in registry with the timing mark (on-projection reverse rotation).
Figure 3:
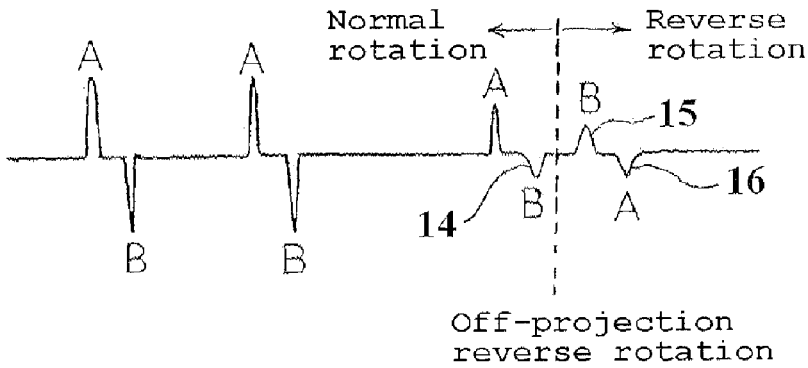
FIG. 3 is a wave form of the sensor outputs during a situation where reverse rotation occurs during the time when the timing mark is not in registry with the timing mark (off-projection reverse rotation).

The reverse rotation determination circuit 31, as described above in reference to FIGS. 1–3, in either case of the in-projection reverse rotation or out-of-projection reverse rotation, determines reverse rotation on the basis of generator voltage from the pulser signal coming from the pulser input circuit 29 and the generator voltage coming from the generator output-input circuit 32. When the generator output decreases below a specified value and the engine turns again in reverse and generator output starts rising an ignition permitting signal or ignition prohibiting signal is transmitted to the ignition circuit 27 through a terminal D. How this is determined and executed will be described later by reference to FIG. 7.

Figure 5:
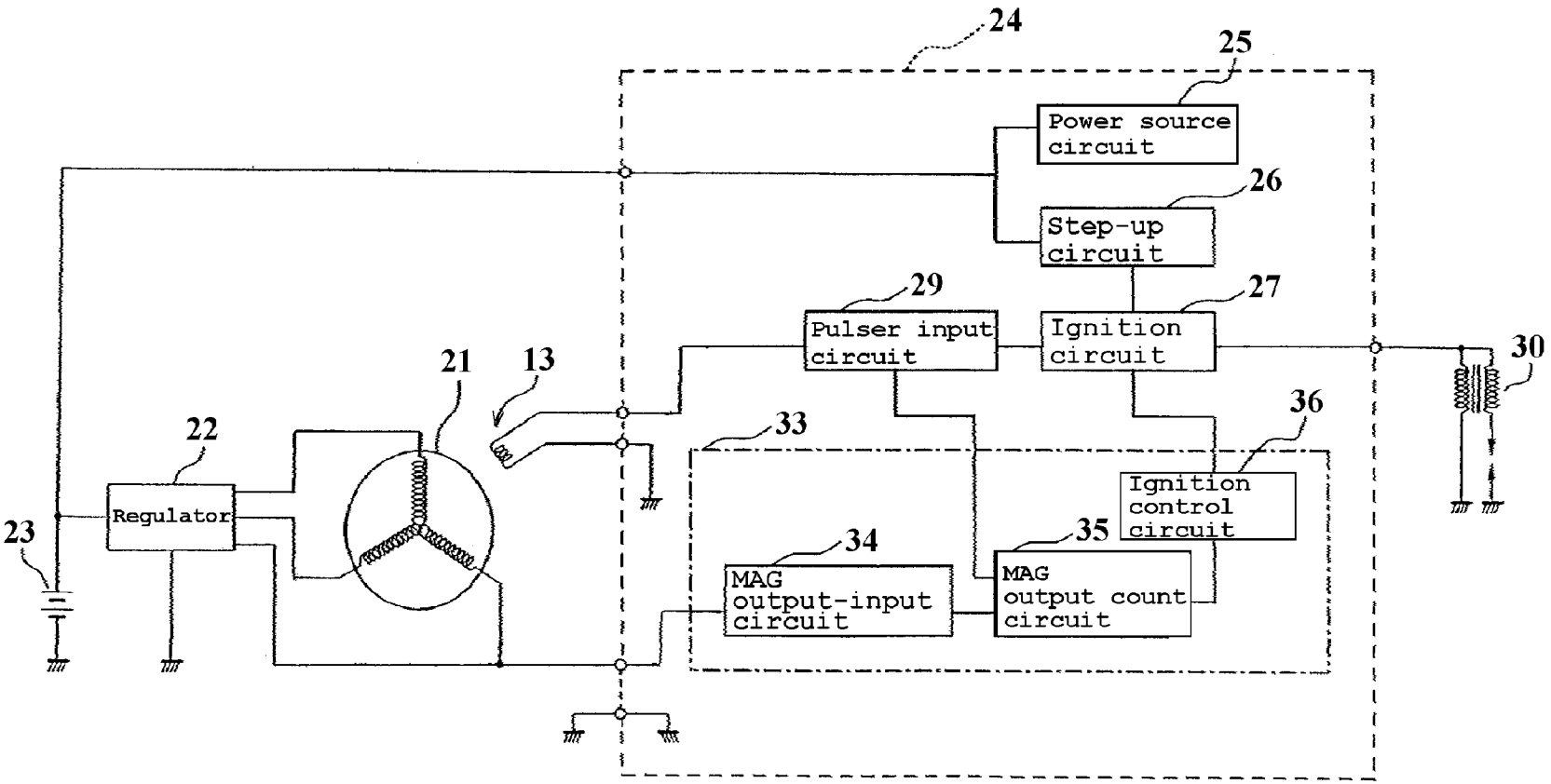
FIG. 5 is a partially schematic view, in part similar to FIG. 1, and shows a second embodiment of a first circuit and construction for precluding kickback.
Figure 6:
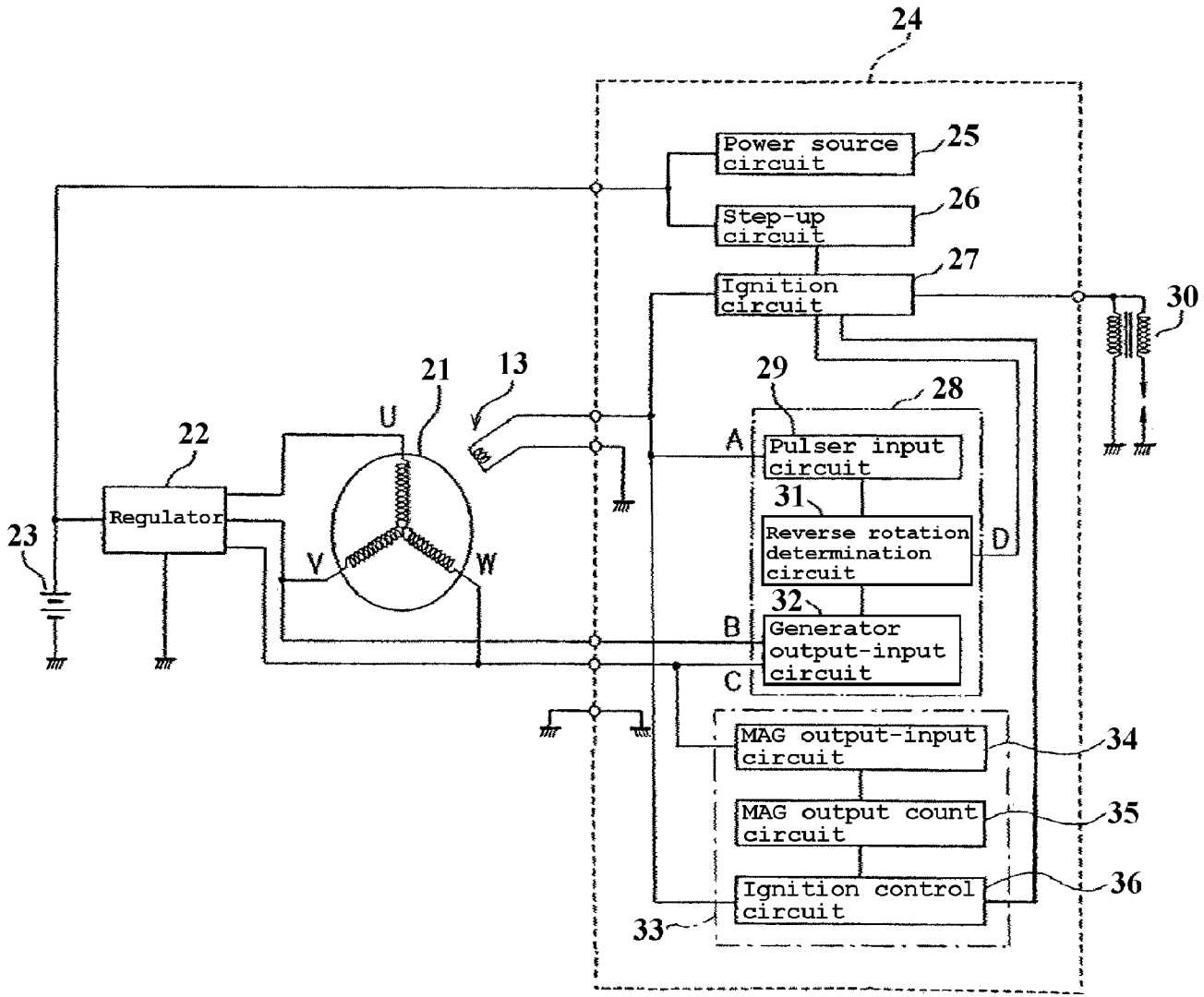
FIG. 6 is a partially schematic view, in part similar to FIGS. 1 and 5, and shows a third embodiment of circuit and construction for precluding kickback.

FIG. 5 shows a circuit construction of an embodiment of the invention. FIG. 6 shows a circuit constitution in which the embodiment of the reverse rotation misfiring circuit shown in FIG. 5 is built in the kickback preventing circuit shown in FIG. 4.

Referring now in detail to FIGS. 5 and 6, a first reverse rotation misfiring circuit 33 is comprised of a MAG output-input circuit 34 for receiving coil output (MAG output) from the generator 21, an MAG output count circuit 35 for counting the number of the MAG outputs, and an ignition control circuit 36 for controlling ignition according to the counted number of the MAG outputs.

If the MAG output counted number from the circuit 35 after a negative pulse from the pulser coil 13 is detected is not greater than a specified value (for example four in the case of FIG. 7) the ignition control circuit 36 gives out an ignition prohibiting signal. This ignition prohibiting signal overrides a prohibition clearing signal produced by the input of a positive pulse for resetting an ignition prohibiting signal during reverse rotation.

Therefore, even if a positive pulse signal for clearing the ignition prohibition is inputted during out-of-projection reverse rotation, the input signal is overridden and the ignition prohibiting state is maintained until the number of the MAG outputs becomes four, so that kickback is reliably prevented from occurring.

Since in in-projection reverse rotation, the reverse rotation determination circuit 31 gives out an ignition prohibiting signal, ignition by the negative pulse when the timing mark leaves immediately after the occurrence of reverse rotation within the timing mark range is prohibited, no kickback occurs and the engine stops.

Figure 7:
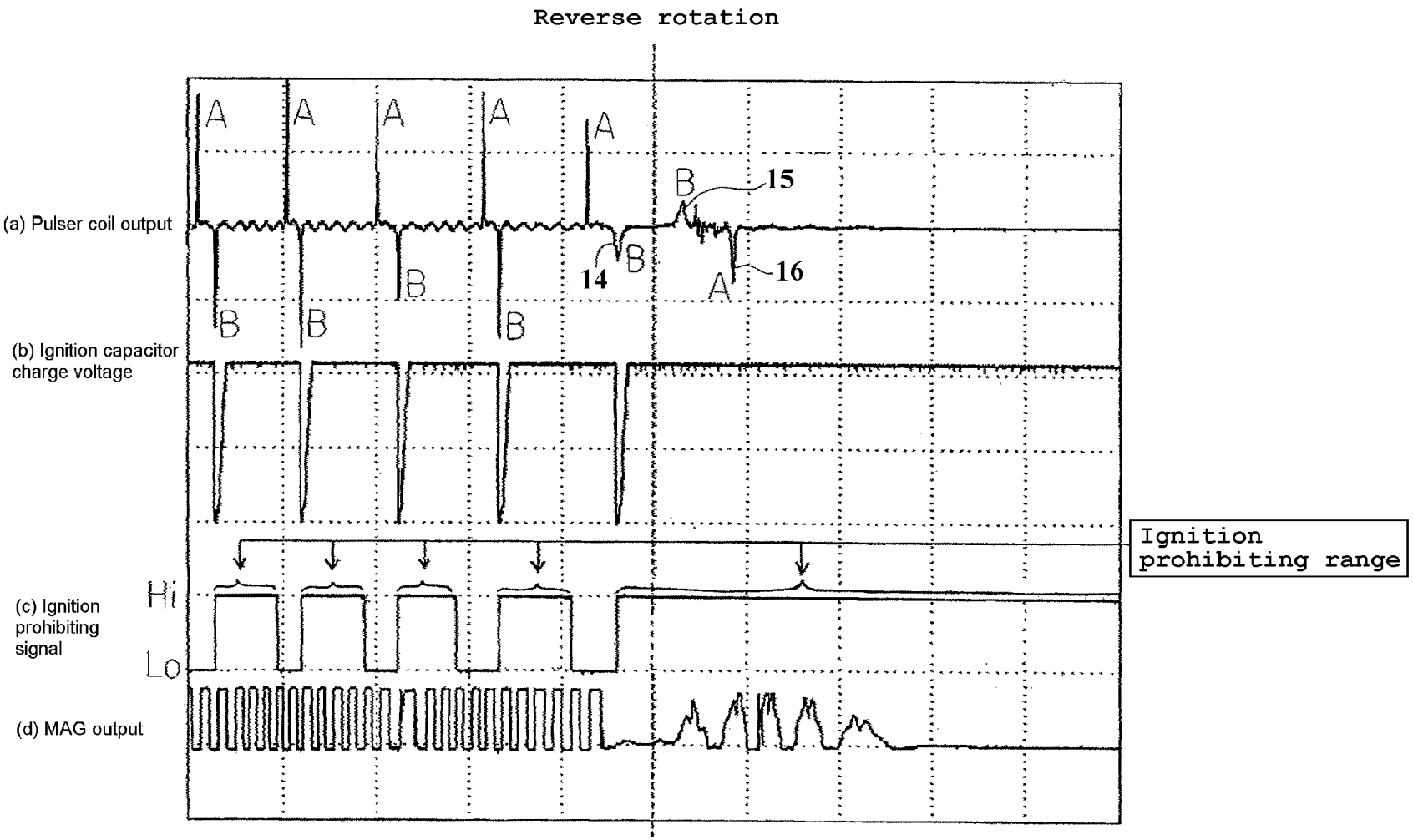
FIG. 7 is a series of traces showing the theory of operation of the embodiments of FIGS. 4, 5 and 6.

FIG. 7 shows waveforms as the reverse rotation preventing circuit of FIG. 5 works. This example shows the situation in out-of-projection reverse rotation. The trace a in this figure shows pulser coil output. In normal rotation as shown above in FIG. 3, the pulser coil detects the ends A and B of the timing mark 21 around the flywheel, and gives out positive and negative outputs, one each per rotation. Using this negative pulse, as shown in trace b, the ignition capacitor discharges to ignite the combustion chamber of the engine.

When out-of-projection reverse rotation occurs, as shown by trace a, the timing mark end B, having produced a negative pulse as it passes by the pulser coil immediately before turning in reverse, turns back, and produces a positive pulse 24 in reverse rotation state, and then a negative pulse 25 is produced with the timing mark end A.

The MAG outputs, as shown by the trace d are produced six in number per rotation. According to this invention, the MAG outputs are counted and an ignition prohibiting signal is produced until the count reaches five. Thus as shown by trace c, ignition is prohibited at Hi and permitted at Lo. Therefore, when the count of coil outputs is four or less, ignition remains in prohibited state.

When the out-of-projection reverse rotation occurs, ignition is prohibited for the period from the moment a negative pulse 14 is produced immediately before reverse rotation to the moment the number of MAG outputs reaches four. Therefore, even if the negative pulse 15 is produced after reverse rotation, an ignition prohibition clearing signal is not outputted and ignition remains prohibited. Therefore, ignition does not occur even if a next negative pulse 16 is produced.

Figure 8:
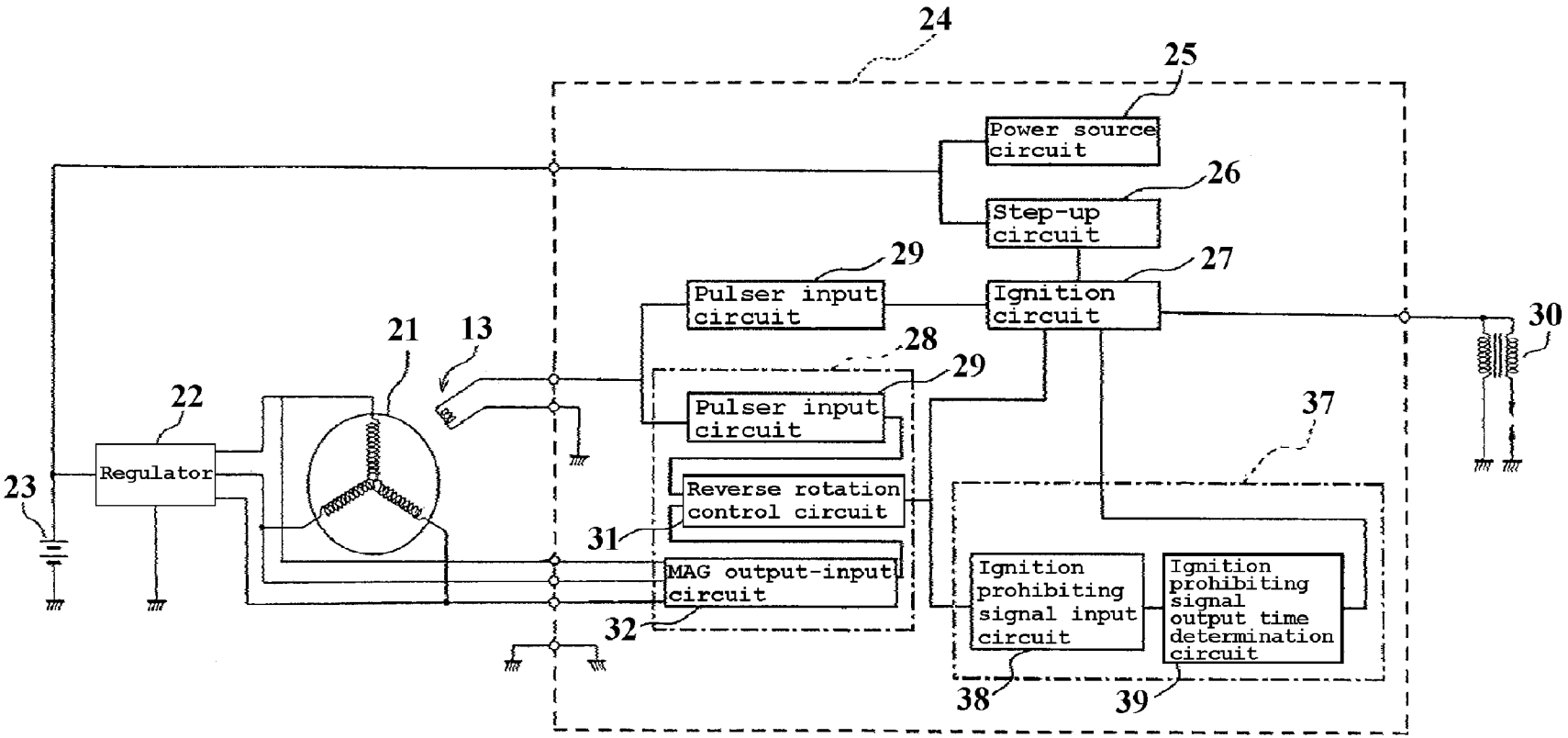
FIG. 8 is a partially schematic view, in part similar to FIGS. 1, 5 and 6 and shows a third embodiment of circuit and construction for precluding kickback.
Figure 9:
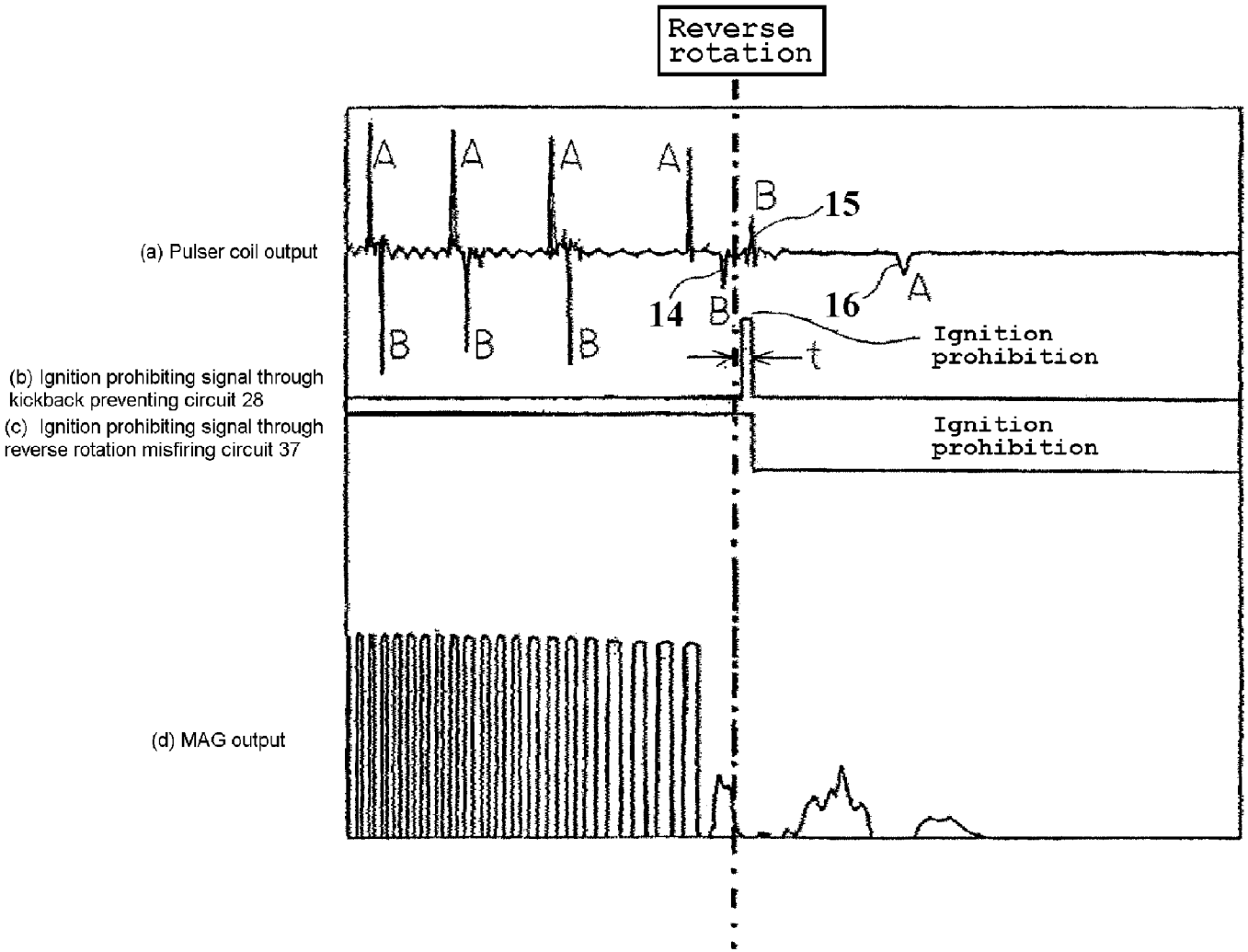
FIG. 9 is a series of traces, in part similar to FIG. 7, showing the theory of operation of the embodiment of FIG. 8.

FIG. 8 is a circuit diagram of another embodiment of the invention and FIG. 9 is a drawing for explaining its operation. In this embodiment where components have substantially the same construction as those already described, they have been identified by the same reference numerals and will be described again only where necessary to understand the construction and operation of this embodiment.

The kickback preventing circuit 28, as described with FIG. 7, determines reverse rotation based on the generator output and thereafter prohibits ignition. When the engine stops after the ignition is prohibited and a positive pulse is inputted later at the time of re-starting, prohibition of ignition is cleared and ignition is made to occur when a negative pulse is inputted next.

A second reverse rotation misfiring circuit 37 of this embodiment is comprised of an ignition prohibition signal input circuit 38, and an ignition prohibition signal output time determination circuit 39. The ignition prohibition signal input circuit 38 is connected to the reverse rotation determination circuit 31 to receive an input of ignition prohibiting signal when reverse rotation is determined and also receives an ignition prohibition clearing signal caused by a next input of a positive pulse.

The ignition prohibition signal output time determination circuit 39 measures the time of the ignition prohibiting state on the basis of the ignition prohibiting signal from the reverse rotation determination circuit 37 inputted to the ignition prohibition signal input circuit 38 and its clearing signal. When the ignition prohibition time is shorter than a specified value, an ignition prohibiting signal is produced to maintain the ignition prohibiting state. In other words, even if reverse rotation is determined with the reverse rotation determination circuit 31 of the kickback preventing circuit 28, if an ignition prohibiting signal is given off, and then ignition prohibition is cleared by an input of a positive pulse, it is determined to be in the midst of reverse rotation when the positive pulse is inputted after a short period of time, and ignition prohibition is maintained.

This will be described in reference to FIG. 9, which shows an example of out-of-projection reverse rotation. In normal rotation as shown by trace (a) the pulser coil detects the ends A and B (FIG. 8) of the timing mark around the flywheel and gives out positive and negative outputs, one each per rotation. By this negative pulse, the ignition capacitor discharges to ignite the combustion chamber of the engine.

When out-of-projection reverse rotation occurs, the timing mark end B having produced a negative pulse 14 as it passes by the pulser coil 13 immediately before turning in reverse, turns back, produces a positive pulse 15 in reverse rotation state, and then a negative pulse 16 is produced with the timing mark end A.

This reverse rotation, as shown by trace (b) is detected with the kickback preventing circuit 28 and the ignition prohibiting state is brought about simultaneously with the detection of reverse rotation. After that, ignition prohibition is cleared by the input of the positive pulse 15 caused by the timing mark end B. The time t of the ignition prohibiting state up to its clearing is detected with the reverse rotation misfiring circuit 37 of this embodiment. If the detected time t is shorter than a specified time, as shown by trace(c), an ignition prohibition signal is given out simultaneously with the clearing of the ignition prohibition to maintain the ignition prohibiting state. Therefore, even if the negative pulse 16 is inputted as caused by the timing mark end A in the reverse rotation state, ignition is not made, and kickback is reliably prevented from occurring.

Figure 10:
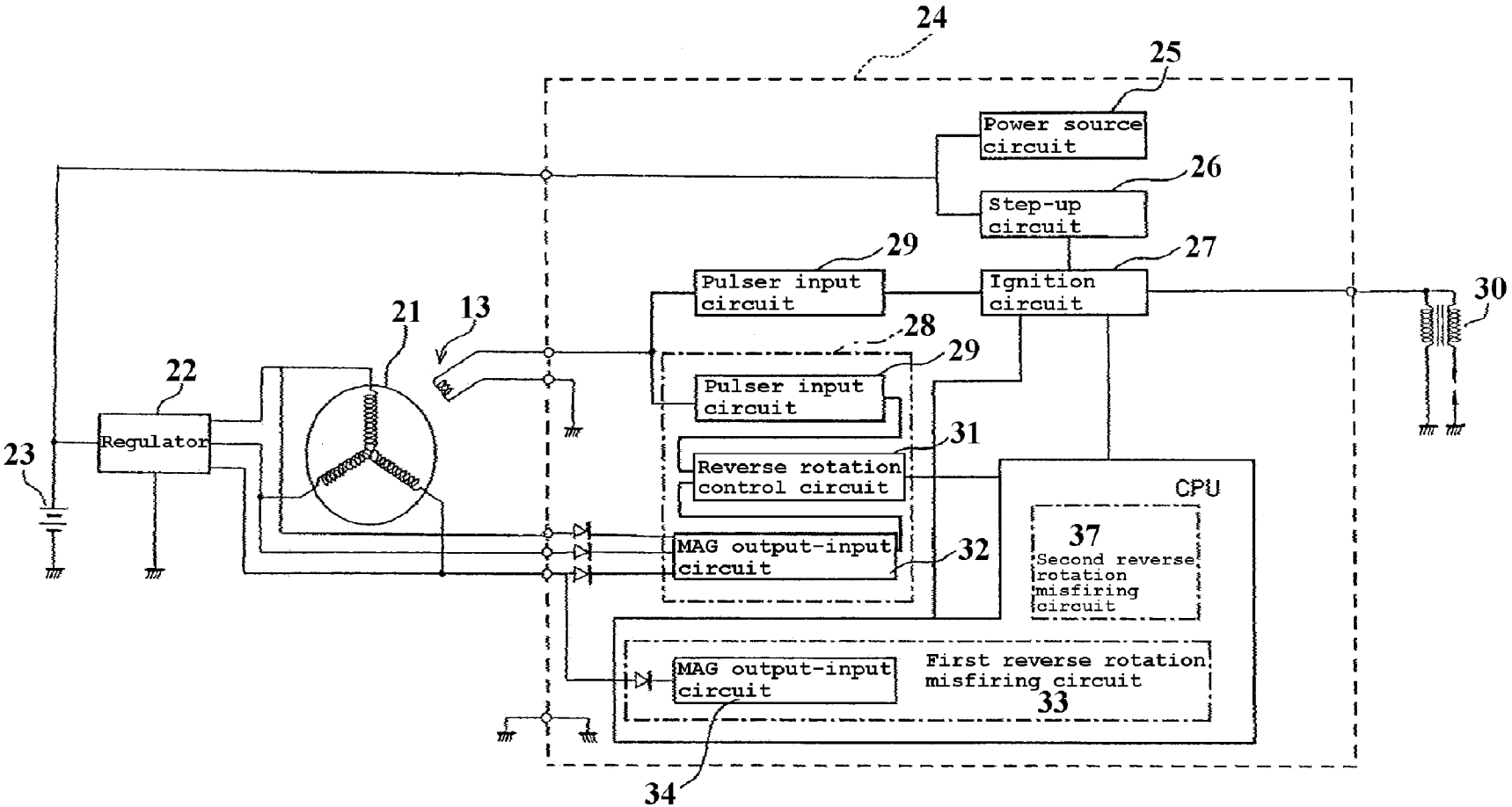
FIG. 10 is a partially schematic view, in part similar to FIGS. 1, 5, 6 and 8 and shows a forth embodiment of circuit and construction for precluding kickback that combines the structures and purposes of the previous embodiments.

FIG. 10 is a schematic circuit diagram of another embodiment of the invention that employs certain components of previously described embodiments. Where that is the case those components are identified by the same reference numerals and those components and their operation need not be described as the foregoing descriptions should permit those skilled in the art to practice the invention of this embodiment.

This embodiment is comprised of a combination of the kickback preventing circuit 28 of the embodiment of FIG. 6, the first reverse rotation misfiring circuit 33 of FIG. 6, and the second reverse rotation misfiring circuit 37 of FIG. 9. Such a circuit constitution reliably detects reverse rotation of any mode and prohibits ignition.

Thus from the foregoing descriptions it should be readily apparent that several embodiments of circuits and methods have been described that quickly and reliably detect reverse rotation or kickback and prevent its continuation while permitting normal resumption of ignition control once the reverse rotation has been stopped. Of course those skilled in the art will readily understand that the described embodiments are only exemplary of forms that the invention may take and that various changes and modifications may be made without departing from the spirit and scope of the invention, as defined by the appended claims.

What is claimed is:

1. A kickback preventing ignition system for an internal combustion engine having a rotating shaft, a timing mark rotating with said shaft and having circumferentially spaced leading and trailing ends, a sensor associated with said timing mark and adapted to produce pulses when said each of said leading and trailing ends pass under rotation of said shaft, a processor for determining that reverse rotation may be occurring based only on a sensed decrease in value of at least one of said pulses and thereafter prohibiting ignition of said engine and reestablishing ignition upon the production of a pulse from the leading edge of said timing mark only after a predetermined time period has elapsed.

2. A kickback preventing ignition system for an internal combustion engine as set forth in claim 1 wherein the circuit counts the number of pulses generated by the sensor and prohibits ignition unless a predetermined number of pulses has been counted.

3. A kickback preventing ignition system for an internal combustion engine as set forth in claim 1 wherein the circuit has a system that counts the time period between when reverse rotation is detected and when the next pulse is received and prohibits ignition if the measured time does not exceed a predetermined value.

4. A kickback preventing ignition system for an internal combustion engine as set forth in claim 3 wherein the circuit counts the number of pulses generated by the sensor and also prohibits ignition unless a predetermined number of pulses has been counted.

* * * * *